11/25/86 XR 4,625,145 SR

United States Patent [19]

Gerritsen et al.

[11] Patent Number: 4,625,145

[45] Date of Patent: Nov. 25, 1986

[54] COLOR DISPLAY TUBE WITH MAGNETIC FIELD SHAPING MEANS

[75] Inventors: Jan Gerritsen; Piet G. J. Barten; Otto Mensies, all of Eindhoven, Netherlands

[73] Assignee: U.S. Philips Corporation, New York, N.Y.

[21] Appl. No.: 657,318

[22] Filed: Oct. 3, 1984

[30] Foreign Application Priority Data

Oct. 6, 1983 [NL] Netherlands ..... 8303423

[51] Int. Cl.[4] ..... H01J 29/56; H01J 29/64

[52] U.S. Cl. ..... 313/413; 313/414; 313/431

[58] Field of Search ..... 313/413, 414, 412, 431; 335/210, 211

[56] References Cited

U.S. PATENT DOCUMENTS

| | | | |
|---|---|---|---|
| 3,594,600 | 7/1971 | Murata et al. | 313/411 |
| 3,860,850 | 1/1975 | Takenaka et al. | 313/431 X |
| 4,196,370 | 4/1980 | Hughes | 313/413 |
| 4,220,897 | 9/1980 | Barten et al. | 315/368 |
| 4,237,437 | 12/1980 | Vink et al. | 335/211 |
| 4,495,438 | 1/1985 | Kornaker | 313/412 |

*Primary Examiner*—Palmer C. DeMeo
*Attorney, Agent, or Firm*—Robert J. Kraus

[57] ABSTRACT

In a color display tube having an electron gun of the "in-line" type for generating three electron beams situated with their axes in one plane, the electron gun includes curved field shapers at the end from which the beams exit into frame and line deflection fields. Each field shaper includes two or more plates of ferromagnetic material aligned along a curve and spaced from each other by slots. The plates are arranged symmetrically with respect to the plane and the central beam axis, and a concave side of each field shaper faces the three beam axes. At least the ends of each field shaper which are most remote from the plane have substantially flat plates extending in the direction of the central electron beam axis. By using such field shapers the losses in the line deflection field are small and substantially undistorted, while a desirable pincushion-shaped distortion of the frame deflection field is intensified.

6 Claims, 22 Drawing Figures

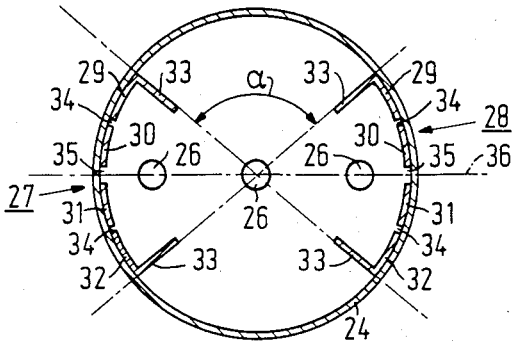
FIG.3
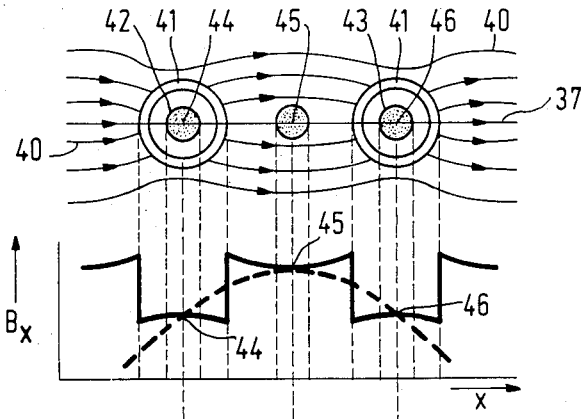
FIG.4a
PRIOR ART
FIG.4b
PRIOR ART
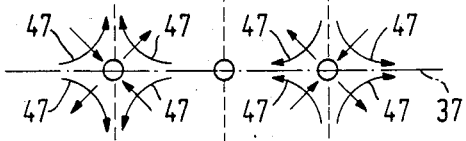
FIG.4c
PRIOR ART
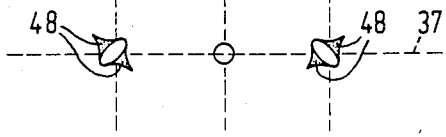
FIG.4d
PRIOR ART

COLOR DISPLAY TUBE WITH MAGNETIC FIELD SHAPING MEANS

BACKGROUND OF THE INVENTION

The invention relates to a colour display tube comprising in an evacuated envelope an electron gun system of the "in-line" type for generating three electron beams situated with their axes in one plane. The axis of the central beam coincides with the tube axis, and the electron beams converge on a display screen which is provided on a wall of the envelope. In operation, the beams are deflected over the display screen in two mutually perpendicular directions by means of a first and a second deflection field. The direction of the first deflection field is parallel to the plane. The electron gun system comprises at its end curved field shapers for causing the rasters described on the display screen by the electron beams to coincide as much as possible each field shaper comprises at least two plates of ferromagnetic material situated substantially in the elongation of each other and separated by gaps. The plates are symmetrical with respect to the plane and the central beam axis. The curved field shapers face the three beams with their concave sides and make the first deflection field pincushion-shaped at the area of the electron beams.

A frequently occurring problem in colour display tubes having an electron gun system of the "in-line" type is coma. This is expressed in the fact that the dimensions of the rasters which are described on the display screen by the two outermost electron beams are different from those of the central beam. This is the result of the eccentric location of the outermost electron beams relative to the field for the vertical deflection (the frame deflection field). In U.S. Pat. No. 4,196,370 a large number of patents are cited in which partial solutions are given. These solutions consist of using magnetic field-conductive and/or screening rings and plates which are mounted at the gun end and which intensify or attenuate the deflection field or the deflection fields locally along a part of the paths of the electron beams. With a number of these means it is possible to cause the rasters described on the display screen by the three electron beams to coincide substantially. However, a disadvantage of the use of such means is that defocusing occurs in the outer beams during deflection which is expressed in a distorted spot on the display screen which is surrounded by a haze. One of the cited Patent Specifications is U.S. Pat. No. 3,594,600 which discloses a colour display tube in which the rasters described by the three electron beams are made to coincide by placing two elongate C-shaped magnetic screens beyond the outermost electron beams. As a result of this the outermost electron beams are screened from the edge field of the line deflection field (the vertical field lines), while the edge field is admitted to the central electron beam. The three electron beams are screened from the edge field of the frame deflection field (the horizontal field lines) which is bypassed entirely around the three beams. These field shapers thus influence only the line coma and not the frame coma.

Netherlands Patent Application No. 7801317, corresonding to U.S. Pat. No. 4,237,437, describes a system of deflection coils in which field-shaping means are provided in the system of deflection coils. They consist, for example, of two soft-magnetic elements which are provided diametrically opposite to each other beyond the line deflection coil, substantially transversely to the magnetic field of the frame deflection coil on the neck side of the system of deflection coils. The disadvantage of the use of such field-shaping means is that a considerable part of the field deflection field is bypassed around the beams by the means so that the deflection sensitivity of the tube-coil system decreases.

A colour display tube of the type described in the opening paragraph is described in Netherlands Patent Application No. 8204465, corresponding to U.S. patent application Ser. No. 851,282 filed on 10 Apr. 1986, which is a continuation of application Ser. No. 548,276 filed on 3 Nov. 1983 which may be considered to be incorporated herein. The field shapers described in these corresponding Patent Applications make the first deflection field (the frame deflection field) pincushion-shaped. This pincushion-shaped field comprises substantially a two-pole field having a six-pole component. As a result of the pincushion shape the field has the correct strength and shape also at the area of rays of the electron beams situated outside the electron beam axes, as a result of which the deflection focusing of the outer beams is considerably reduced. In contrast with the field shapers in the system of deflection coils according to Netherlands Patent Application No. 7801317, the field shapers disclosed in Netherlands Application No. 8204465 are situated comparatively closely to the electron beams, and therefore only a comparatively small part of the deflection field is distorted as a result of which only little extra deflection energy is necessary. It is also described in Netherlands Patent Application No. 8204465 that it is useful to provide slots in the field shapers and to manufacture field shapers from two or three plates situated in the elongation of each other. The object of this is to reduce the losses in the line deflection field (the second deflection field).

In Netherlands Patent Application No. 8301712, corresponding to U.S. patent application Ser. No. 607,544 filed on 7 May 1984, which may be considered to be incorporated herein, measures are taken to reduce the losses in the second deflection field. According to this Patent Application the field shapers each consist of at least two plates which are situated in the elongation of each other and which are situated in the manner as described in the opening paragraph relative to the plane through the beam axes and the tube axis. On the side remote from the electron beams the slots between the plates are overlapped at a distance from the plates by other plates, so that "magnetic shunts" for the second deflection field are created in each field shaper.

SUMMARY OF THE INVENTION

It is an object of the invention to provide a colour display tube in which the losses in the second deflection field as a result of the field shapers are even further reduced, the second deflection field being substantially undistorted and the desired pincushion-shaped distortion of the first deflection field in the field shapers being intensified.

For that purpose, according to the invention, a colour display tube of the kind mentioned in the opening paragraph is characterized in that in each field shaper at least the plates which are situated farthest from the plane are provided at their ends remote from the plane with substantially flat plates extending substantially in a direction towards the central electron beam.

The invention is based on the recognition of the fact that by providing the substantially flat plates extending substantially towards the central electron beam, the first deflection field (the frame deflection field) is guided more towards the central beam so that the field becomes more pincushion-shaped. Because of the radially directed plates, a part of the second deflection field (the line deflection field) which otherwise is bypassed around the beams via the tangentially situated plates (the plates situated substantially in the elongation of each other) is directed more towards the beams so that the field at the area of the electron beams is intensified with respect to the field shapers without the radially directed plates disclosed in Netherlands Patent Applications Nos. 8204465 and 8301712. An advantage of making the first deflection field locally more pincushion-shaped is that the desired coma correction is obtained to a more considerable extent as a result of which the length of the field shapers, viewed in the direction of propagation of the central electron beam, may be smaller than the length of the field shapers as described in the Netherlands Patent Applications Nos. 8204465 and 8301712. As a result of the smaller length of the field shapers, a smaller loss of energy of the second deflection field occurs. The tangentially situated parts of the field shapers may also form shorter arcs, as compared with the field shapers according to Netherlands Patent Application No. 8204465, as a result of which a smaller loss of the second deflection field (the line field) also occurs.

Measurements in display tubes according to the invention have demonstrated that substantially no loss of line field occurs, as compared with the tubes having field shapers as described in the Netherlands Patent Applications Nos. 8204465 and 8301712. Moreover it is found that the line coma, the line astigmatism and frame astigmatism and the anisotropic astigmatism deviate only slightly from those of conventional coma correction means, so that the deflection coils need be adapted only slightly or need not be adapted at all when the field shapers according to the invention are introduced.

The use of field shapers in deflection coils (Netherlands Patent Application No. 7801317) having radially extending parts is difficult. The effective guiding of the deflection fields towards the electron beams is only possible in the electron gun system and in the manner according to the invention.

A first preferred embodiment of the field shapers for a display tube according to the invention is characterized in that each field shaper comprises four plates which are situated substantially in the elongation of each other and symmetrically with respect to the plane and are separated by three slots.

By providing one or more slots the attenuation of the second deflection field at the area of the beams is reduced and with a correct proportioning of the slots it can be achieved that the field at the area of the electron beams is substantially homogeneous.

A second preferred embodiment of the field shapers for a display tube according to the invention is characterized in that the slot intersecting the plane is wider than the slots on opposite sides of the plane. By making the slot intersecting the plane to be wider it is achieved that the second deflection field at the area of the beams becomes more homogeneous.

A third preferred embodiment of the field shapers for a display tube according to the invention is characterized in that the plates situated nearest to the plane in addition comprise at their ends remote from the plane substantially flat plates extending substantially in the direction of the central electron beam. As a result of the provision of the additional plates, the shape of the first deflection field at the area of the electron beams is made even more pincushion-shaped.

A fourth preferred embodiment of the field shapers for a display tube according to the invention is characterized in that the electron gun system at its end comprises a centering cup, the plates situated substantially in the elongation of each other being connected against the inner wall or the outer wall of the centering cup. In this manner it is possible to connect the field shapers to the electron gun system in a simple manner. When the plates situated substantially in the elongation of each other are connected against the outer wall of the centering cup, the centering cup should comprise slots through which the substantially flat plates extend in the direction of the central electron beam. By placing the plates partly inside and outside the centering cup, the influence of the slots on the second deflection field (the line field) can be varied.

A fifth preferred embodiment of the field shapers for a display tube according to the invention is characterized in that at least one of the slots between the plates is overlapped in known manner by shunt plates on the side remote from the electron beams at a distance from the plates. As a result of the shunt plates a magnetic resistance in the field shapers is obtained in which the field is less distorted.

BRIEF DESCRIPTION OF THE DRAWING

The invention will now be described in greater detail, by way of example, with reference to the accompanying drawing, in which:

FIG. 3 is a cross-sectional view through FIG. 2;

FIGS. 4*a, b, c* and *d* diagrammatically show a prior art solution and the affect on the beam and spot thereof, as well as the desired field;

DESCRIPTION OF THE PREFERRED EMBODIMENTS

Figure 1:
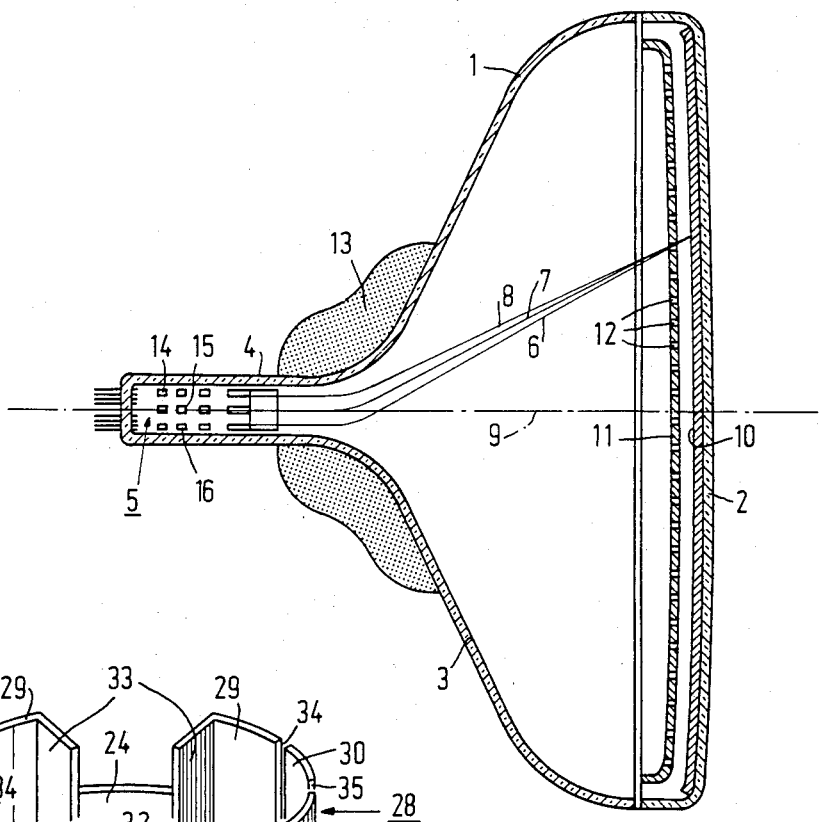
FIG. 1 is a longitudinal sectional view of a colour display tube according to the invention.

FIG. 1 is a longitudinal sectional view of a colour display tube of the "in-line" type according to the invention. An electron gun system 5 which generates three electron beams 6, 7 and 8 situated with their axes in one plane (the plane of the drawing) is provided in the neck 4 of a glass envelope 1 which is composed of a display window 2, a cone 3 and the neck 4. Prior to deflection, the axis of the central electron beam 7 coincides with the tube axis 9. The display window comprises on its inside a large number of triplets of phosphor lines. Each triplet comprises a line consisting of a blue-luminescing phosphor, a line consisting of a green-luminescing phosphor and a line consisting of a red-luminescing phosphor. All triplets together constitute the display screen 10. The phosphor lines are perpendicular to the plane of the drawing. In front of the display screen is positioned a shadow mask 11 in which a very large number of elongate apertures 12 are provided through which the electron beams 6, 7 and 8 pass which each impinge only on phosphor lines of one colour. The three electron beams situated in one plane are deflected by the system of deflection coils 13. The beams are given a frame coma correction without distorting the spots of the outermost electron beams and substantially without loss of deflection energy of the line field as will be explained hereinafter in the following figures.

Figure 2:
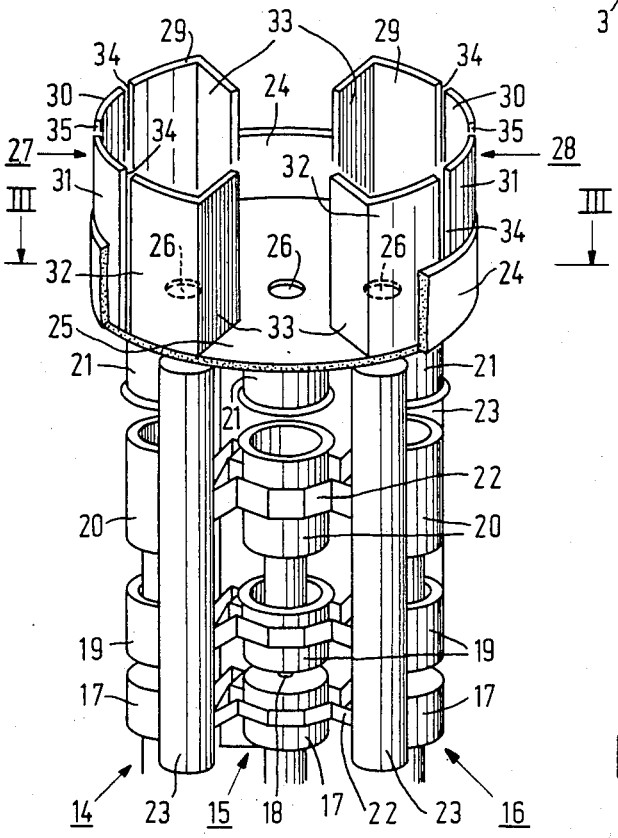
FIG. 2 is an elevation, partly broken away, of an electron gun system as used in the tube shown in FIG. 1.

FIG. 2 is a broken-away elevation of the electron gun system 5. It consists in this case of three separate electron guns 14, 15 and 16. However, the display tube in accordance with the invention may have a so-called integrated electron gun system as described, for example, in U.S. Pat. No. 4,196,370 in which the electron guns have a number of electrodes in common. The guns 14, 15 and 16 each comprise a control electrode 17 which has an aperture 18. Opposite to the aperture in the control electrode is provided a cathode (not visible) for generating the electron beams. Each gun further comprises a second grid 19, a third grid 20 and a fourth grid 21. The grids 17, 19 and 20 are connected to glass rods 23 by means of metal bands 22. The grids 21 are connected against the bottom of the common centering cup 24 of a non-ferromagnetic material. The bottom 25 of the broken-away centering cup 24 has three apertures 26 through which the electron beams pass. Two curved field shapers 27 and 28 are provided against the inner wall of the centering cup 24 and each consists of four curved plates 29, 30, 31 and 32, and plates 33 extending towards the central electron beam axis. The plate 33 may be connected to the plates 29 and 32 or may be formed integral therewith. The plates 33 may also be slightly curved or bent. All plates consist of a ferromagnetic material having a thickness of 0.25 mm (for example, an alloy having 58% by weight of nickel and 42% by weight of iron). The plates have a length of approximately 10 mm measured in the direction of propagation of the electron beams. Slots 34 (0.5 mm wide) are provided between the plates 29 and 30 and the plates 31 and 32. Slots 1 mm wide are provided between the plates 30 and 31. The diameter of the centering cup 24 is approximately 22 mm. The width of the plates 30 and 31 in the flat condition is 2.8 mm. The width of the plates 29 and 32 in the flat condition is 3.7 mm and the width of the plates 33 is 3.7 mm. If a magnetized multipole ring for the static convergence of the electron beams is used in the tube, as is disclosed in U.S. Pat. No. 4,220,897, it is preferably connected to the bottom of the centering cup 24. The field shapers are then preferably provided at a distance of at least 2 mm from the ring in connection with the magnetization of the multipole ring.

FIG. 3 is a sectional view through the centering cup 24 of FIG. 2 in which the same reference numerals are used as in FIG. 2. By a suitable choice of the length of the plates 29 to 33 measured in the direction of the tube axis and of the angle $\alpha$, the desired extent of pincushion-shaped field shaping of the frame deflection field (the first deflection field) parallel to line 36 and optionally also the line deflection field (the second deflection field) which is perpendicular thereto, can be influenced. The field shapers are symmetrical with respect to the plane through the beam axes (the plane of the drawing of FIG. 1) and symmetrical with respect to the tube axis 9 which coincides with the axis of the central electron beam prior to deflection. As will be explained with reference to FIG. 8, a part of the plates may also be disposed outside the centering cup. It is also possible to use no centering cup and to connect the field shapers together, for example, by means of glass beads.

As is shown diagrammatically in FIG. 4*a*, the magnetic field lines 40 are obstructed by the known rings 41 around the outermost electron beams 42 and 43. The field strength variation $B_x$ in the plane through the axes (44, 45, 46) which is the result thereof, is shown as a solid line in FIG. 4*b*. The desired coma free field is shown by a broken line. By using the rings 41, the magnetic field $B_x$ at the area of the beam axes 44, 45 and 46 is equal to the desired magnetic field and the three rasters formed on the display screen are made to coincide. For the rays of the outermost beams 40 and 43 not coinciding with the beam axes the field does not have the correct field strength variation so that a quadrupole lens action (quadrupole field lines 47) shown in FIG. 4*c* is exerted on the beams, resulting in deflection defocusing of the side beams. The radial arrows in FIG. 4*c* denote the forces which act on the beams. The spots on the display screen shown in FIG. 4*d* become elliptical and are surrounded by a haze. The axes of the ellipses in FIG. 4*d* make an angle of 45° with the line 37. The ellipticity of the spots is the result of an underfocusing. The shaded haze regions 48 are the result of overfocusing.

Figure 5A:
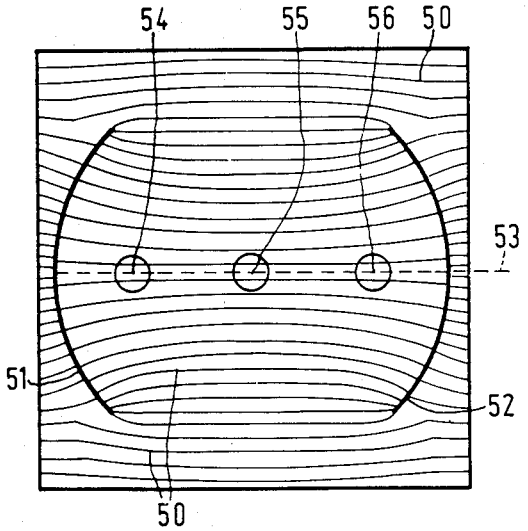
FIG. 5*a* shows a part of the frame field with field shapers as described in a prior Patent Application.
Figure 5B:
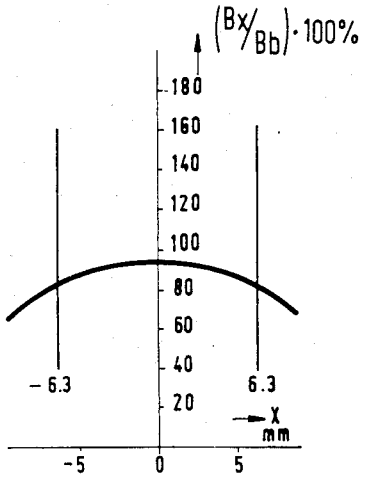
FIG. 5*b* shows the variation of the frame deflection field divided by the frame deflection field produced by the deflection coils as a function of the place x on the axis perpendicular to the beam axes.
Figure 5C:
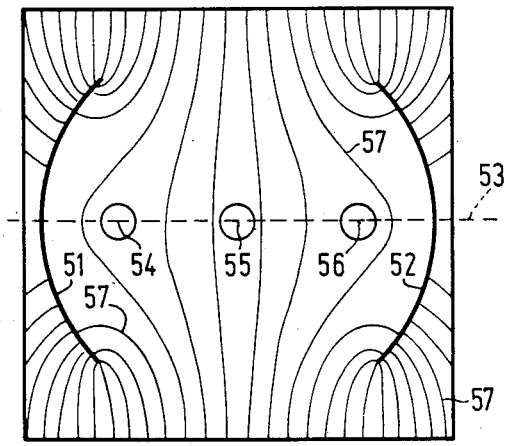
FIG. 5*c* shows a part of the line field with field shapers as described in a prior Patent Application.
Figure 5D:
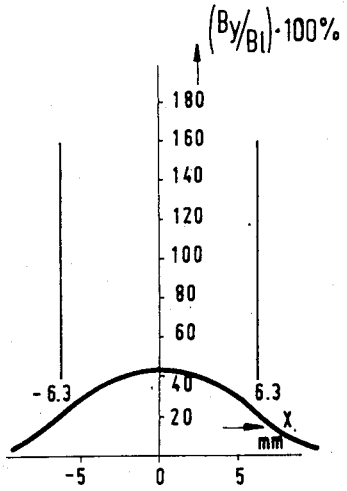
FIG. 5*d* shows the variation of the line field divided by the line field produced by the deflection coils as a function of the place x on an axis perpendicular to the beam axes.

FIGS. 5*a, b, c* and *d* further explain the operation of field shapers as they are described in the already mentioned Netherlands Patent Application No. 8204465. FIG. 5*a* shows a part of the frame deflection field (the first deflection field) of which a number of field lines 50 are shown. In this field two field shapers 51 and 52 which each consist of one piece are placed on the gun end and distort the frame deflection field in the desired manner in a pincushion-shaped manner. The pincushion-shaped field consists mainly of a bipole field having a sixpole component. FIG. 5*b* shows the variation of the magnetic field $B_x$, the frame deflection field, divided by the frame deflection field $B_b$ produced by the deflection coils as a function of the place x on the axis 53. The mutual distance between the axes of the electron beams 54, 55 and 56 at the area of the field shapers is approximately 6.3 mm. With such a field variation which corresponds to the desired field according to the broken line in FIG. 4*b*, it is possible to eliminate the quadrupole error at the area of the outer beams 54 and 56 and thus to reduce the deflection defocusing of these beams considerably. FIG. 5*c* shows a part of the line field (the second deflection field) of which a number of field lines 57 are shown. FIG. 5*d* shows the variation of the magnetic field $B_y$, the line field, divided by the line field $B_1$ produced by the deflection coils as a function of the place x on the axis 53. From FIGS. 5*c* and *d* it follows that the line field at the area of the field shapers is attenuated considerably by the configuration of field shapers, especially near the outer beams 54 and 56. This means that line coma will occur.

Figure 6A:
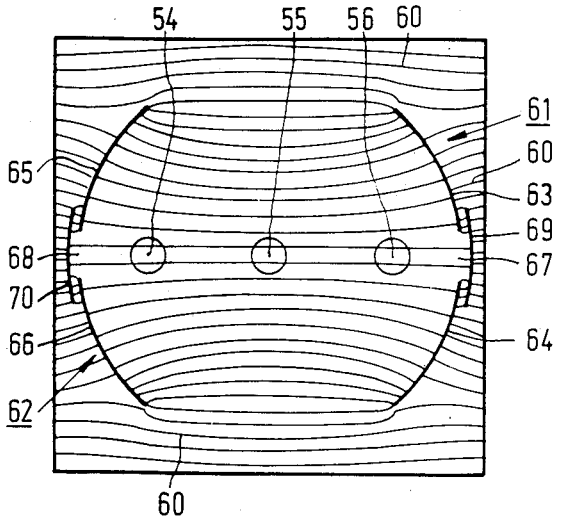
FIG. 6*a* shows a figure analogous to FIG. 5*a* but this time with overlapped slots in the field shapers, as described in a prior Patent Application.

FIGS. 6*a, b, c* and *d* further explain the operation of field shapers as they are described in the already mentioned Netherlands Patent application No. 8301712.

FIG. 6*a* shows, in a manner analogous to FIG. 5*a*, a part of the frame deflection field of which a number of field lines 60 are shown. In this field two curved field shapers 61 and 62 are placed, each consisting of two curved plates 63, 64 and 65, 66 respectively. The two plates forming each field shaper are aligned along a curve and are spaced from each other. Two curved plates 69 and 70 cover the slots 67 and 68. Alternatively, the plates 69 and 70 may be flat. From FIG. 6*b*, which is analogous to FIG. 5*b* it follows that the frame deflection field variation has not changed much as compared with the frame deflection field variation shown in FIG. 6*a* as a result of the provision of the plates 69 and 70.

Figure 6B:
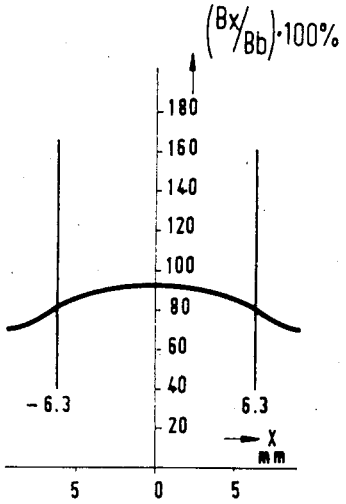
FIG. 6*b* shows a graph analogous to FIG. 5*b* for the field shapers and the field as shown in FIG. 6*a;*
Figure 6C:
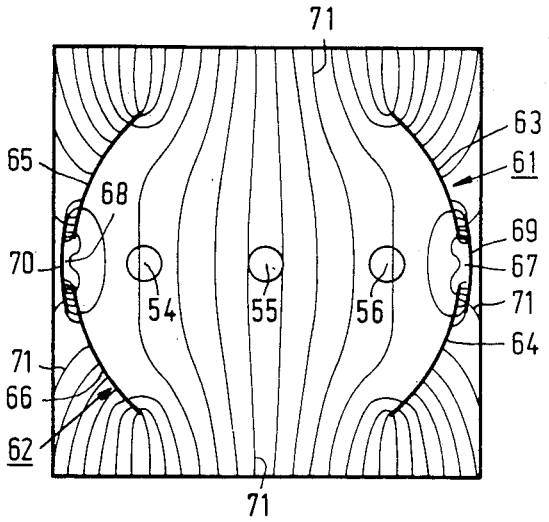
FIG. 6*c* shows a figure analogous to FIG. 5*c* but now with overlapped slots in the field shapers, as described in a prior Patent Application.
Figure 6D:
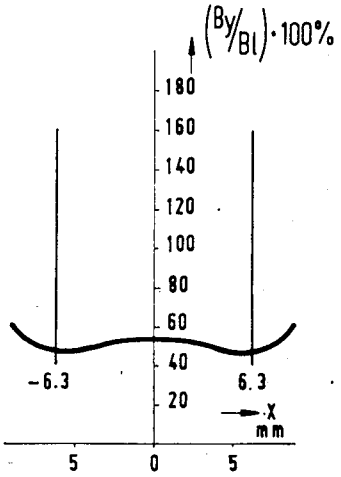
FIG. 6*d* shows a graph analogous to FIG. 5*d* for the field shapers and the field as shown in FIG. 6*c;*

FIG. 6*c* shows a part of the line field of which a number of field lines 71 are shown. From FIG. 6*d* which is analogous to FIG. 5*d* it follows that, although the line field is attenuated by providing the slots 67 and 68, the variation in the x direction is also comparatively flat. In other words, the line field is distorted less as compared with FIG. 5*d*. This also follows from the comparison of FIGS. 5*c* and 6*c*.

Figure 7A:
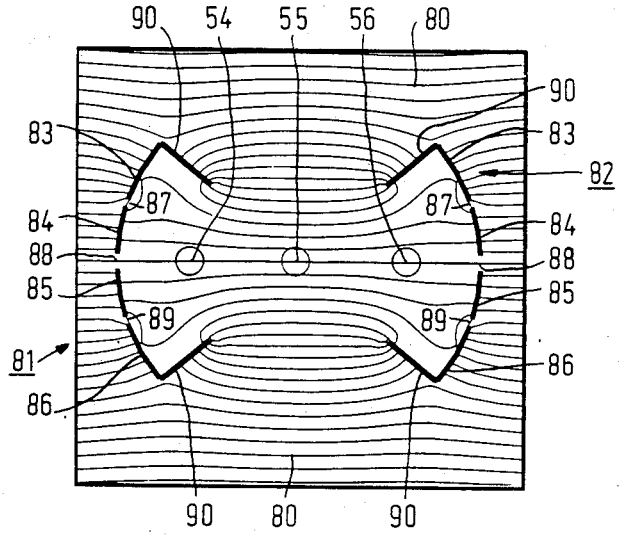
FIG. 7*a* shows a figure analogous to FIGS. 5*a* and 6*a* but now with field shapers for a display tube according to the invention.

FIGS. 7*a, b, c* and *d* further explain the operation of the field shapers for a colour display tube according to the invention and as shown in FIG. 2. FIG. 7*a* shows in a manner analogous to FIGS. 5*a* and 6*a* a part of the frame deflection field of which a number of field lines 80 are shown. In this field, two curved field shapers 81 and 82 are placed in the manner as is also shown in FIG. 2. Each field shaper consists of four aligned, curved plates 83, 84, 85 and 86 which are spaced from each other by slots 87, 88 and 89. Plates 90 extend from the ends of the plates 83 and 86 in the direction of the axis of the central electron beam 55.

Figure 7B:
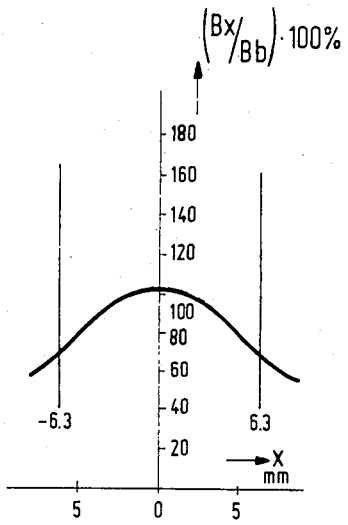
FIG. 7*b* shows a graph analogous to FIGS. 5*b* and 6*b* for the field shapers and the field as shown in FIG. 7*a;*

From FIG. 7*b*, which is analogous to FIGS. 5*b* and 6*b*, it follows that the frame deflection field variation is considerably more pincushion-shaped as a result of the provision of the plates 90. In order to obtain the desired amount of frame coma the field shapers 81 and 82 may therefore be shorter, the length being measured in the direction of propagation of the central electron beam. As a result of the smaller length of the field shapers even a smaller loss occurs in the line field.

Figure 7C:
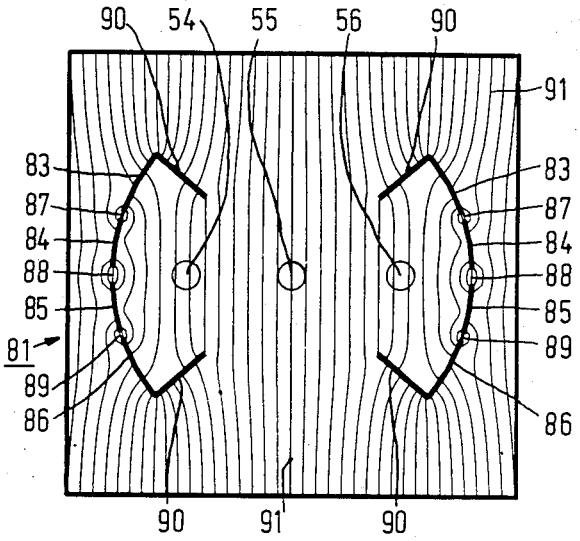
FIG. 7*c* shows a figure analogous to FIGS. 5*c* and 6*c* but now with field shapers for a display tube according to the invention.
Figure 7D:
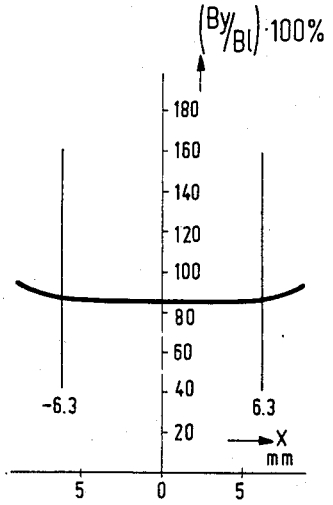
FIG. 7*d* shows a graph analogous to FIGS. 5*d* and 6*d* for the field shapers and the field shown in FIG. 7*c;*

FIG. 7*c* shows a part of the line field of which a number of field lines 91 are shown. From FIG. 7*d* which is analogous to FIG. 6*d* it follows that the line field is less attenuated as a result of the provision of the plates 90 than in the FIGS. 6*c* and 6*d* situation, while moreover the variation in the x direction is even flatter than in FIG. 6*d*. This also follows from comparison of FIGS. 6*c* and 7*c*.

Figure 8:
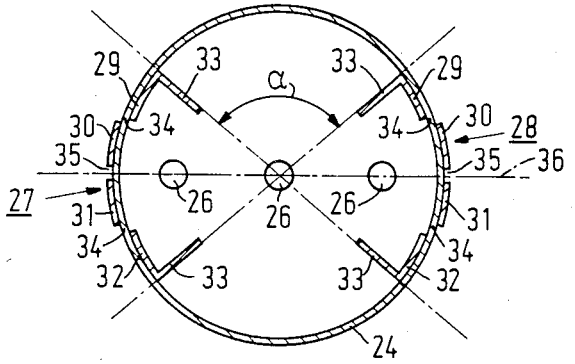
FIG. 8 shows another embodiment of the field shapers for a display tube according to the invention in a cross-sectional view analogous to FIG. 3.

FIG. 8 is a sectional view analogous to FIG. 3 of another embodiment of the field shapers for a display tube according to the invention. For clarity the reference numerals in this figure are identical to those of FIG. 3. The plates 30 and 31 of the field shapers 27 and 28 are placed on the outside against the centering cup 24. As a result of this different location of the plates and the slots 34, the shape of the line field (the second deflection field) can be influenced. The plates 29, 30, 31 and 32, which together constitute the curved field shapers 27 and 28 may also be flat. When the plates 29 and 32 are also placed on the outside against the centering cup 24, slots must be provided in the centering cup 24 so that the plates 33 can extend into the centering cup.

Figure 9:
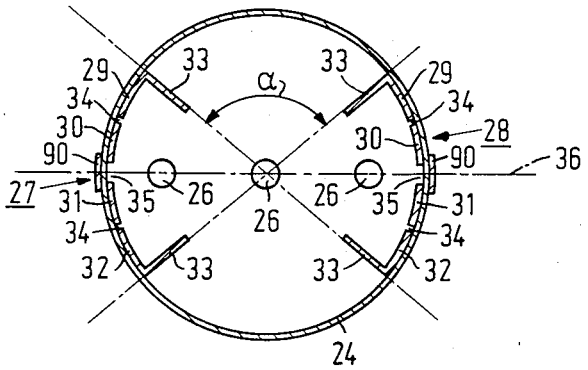
FIG. 9 shows still another embodiment of the field shapers for a display tube according to the invention in a cross-sectional view analogous to FIG. 3.

FIG. 9 is a sectional view analogous to FIG. 3 of still another embodiment of the field shapers for a display tube according to the invention. For clarity, the reference numerals in this figure are again identical to those of FIG. 3. The slots 35 in this embodiment are covered on the side remote from the electron beams by plates 90 in the manner as described in the Netherlands Patent Application No. 8301712. In this manner the shape of the line field (the second deflection field) can be influenced. It is also possible to cover the slots 34 in this manner.

Figure 10A:
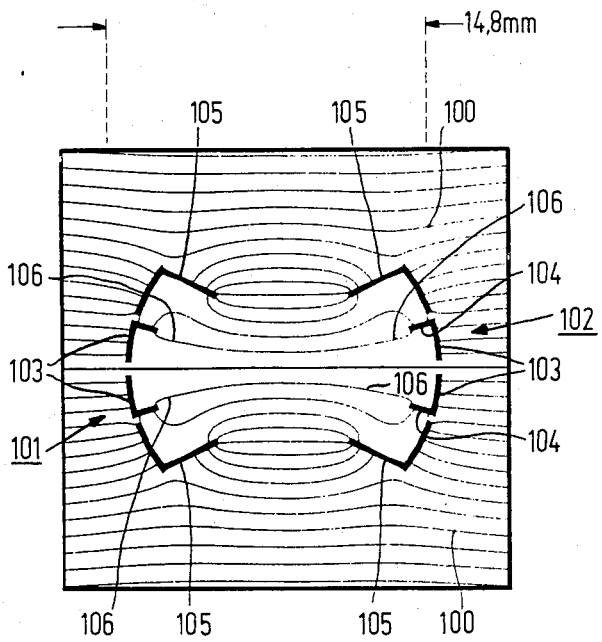
FIG. 10*a* shows a figure analogous to FIG. 7*a* with field shapers for a display tube according to the invention.

FIGS. 10*a, b, c* and *d* further explain the operation of another type of field shapers for a colour display tube according to the invention. FIG. 10*a* shows in a manner analogous to FIG. 7*a* a part of the frame deflection field, a number of field lines 100 being shown. Two curved field shapers 101 and 102 are placed in the field. The difference from FIG. 7*a* is that in this case they are field shapers for a so-called "mini-neck" tube having a neck diameter of approximately 22.5 mm and a mutual beam distance of 4.4 mm. The plates 103 situated nearest to the plane are provided with flat plates 104 at their ends remote from the plane through the beam axes which, like the plates 105, extend inwardly in the direction of the central electron beam axis. As is shown, the field lines 106 are drawn to the outside by the plates 104, as a result of which an even better pincushion-shaped field is obtained. The curved plates are placed against the inner wall of the centering cup having an inside diameter of 14.8 mm (not shown). The dimensions of the plates can be derived from FIG. 10*a* by scaling.

Figure 10B:
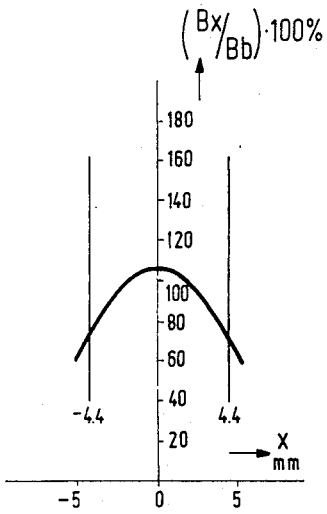
FIG. 10*b* shows a graph analogous to FIG. 7*b* for the field shapers shown in FIG. 10*a;*

From FIG. 10*b*, which is analogous to FIG. 7*b*, it follows that the frame deflection field variation is strongly pincushion-shaped. In order to obtain the desired quantity of frame coma the field shapers 101 and 102 may be shorter in the direction perpendicular to the plane of the drawing of FIG. 10*a* than field shapers without the plates 104 and 105. This smaller length again results in smaller line field losses.

Figure 10C:
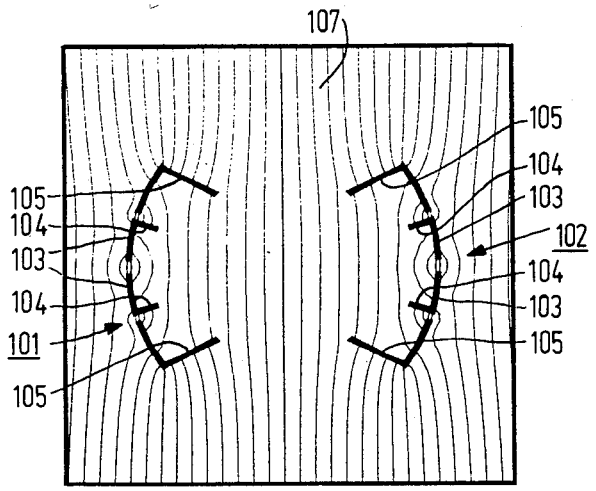
FIG. 10*c* shows a figure analogous to FIG. 7*c* with field shapers for a display tube according to the invention.
Figure 10D:
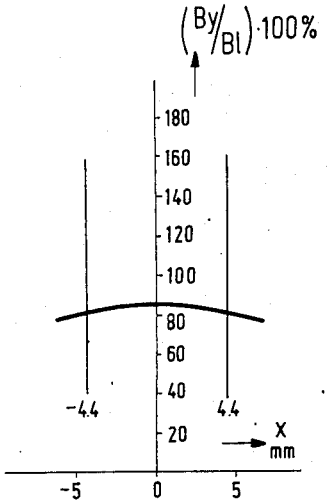
FIG. 10*d* shows a graph analogous to FIG. 7*d* for field shapers and the field shown in FIG. 10*c.*

FIG. 10*c* shows a part of the line field of which a number of field lines 107 are shown. From FIG. 10*c* and FIG. 10*d*, which is analogous to FIG. *7d*, it follows that the line field is attenuated only to a small extent by providing the plates 105 and 104 and the slots between the plates and is substantially not distorted at the area of the electron beams.

What is claimed is:

1. A color display tube comprising:

(a) an evacuated envelope having a display window with an inner surface supporting a luminescent display screen;

(b) an electron gun system for producing central and first and second outer electron beams having their axes lying in a longitudinal plane intersecting the display screen, and for converging the electron beams toward a point of coincidence on said display screen;

(c) first and second deflection means disposed around the electron beam axes for producing first and second deflection fields for deflecting the electron beam in a first direction perpendicular to the longitudinal plane and in a second direction parallel to said plane, respectively; and (d) field shaping means, arranged at one end of the electron gun system from which the electron beams exit, for locally distorting at least one of the deflection fields to augment convergence of the electron beams such that there is coincidence on the display screen of respective rasters produced by said electron beams;

characterized in that the field shaping means comprises first and second ferromagnetic field shapers defining respective curves and having concave sides facing and symmetrically disposed with respect to the central beam axis, each field shaper comprising at least two spaced-apart plates aligned along the respective curve defined thereby and symmetrically disposed on opposite sides of said plane, at least the ends of each field shaper which are most remote from said plane including substantially flat plates extending toward the central beam axis;

said field shapers locally distorting the first deflection field to a pin-cushion shape without significantly distorting or attenuating the second deflection field, and effecting coincidence of said rasters without substantially defocusing the electron beams.

2. A color display tube as in claim 1 where each field shaper comprises four spaced-apart plates aligned along the respective curve defined thereby, two of said plates being disposed on one side of the plane and the other two plates being disposed on the opposite side of said plane.

3. A color display tube as in claim 2 where, in each field shaper, a space separating the two plates closest to the plane is larger than spaces separating the latter plates from the two other plates.

4. A color display tube as in claim 2 where, in each field shaper, the plates situated closest to the plane comprise, at their ends remote from said plane, substantially flat plates extending toward the central electron beam axis.

5. A color display tube as in claim 1, 2, 3 or 4 where the electron gun system includes a cylindrical member surrounding the electron beam axes and where the plates forming the field shapers are disposed on said cylindrical member.

6. A color display tube as in claim 1, 2, 3 or 4 where each field shaper includes at least one shunt plate covering a respective one of the spaces between the spaced-apart plates.

* * * * *